US007299754B2

(12) United States Patent
Stanford et al.

(10) Patent No.: US 7,299,754 B2
(45) **Date of Patent: *Nov. 27, 2007**

(54) TABLE WITH RECEIVING MEMBERS

(76) Inventors: Carl R. Stanford, 2153 N. 1300 West, Clinton, UT (US) 84015; L. Curtis Strong, 65 N. 250 West, Clearfield, UT (US) 84015; Ray Adams, 229 W. 90 North, Clearfield, UT (US) 84015; David C. Winter, 1956 E. 2050 North, Layton, UT (US) 84040; Edward G. vanNimwegen, 2899 N. Cherry Dr., North Ogden, UT (US) 84414

( * ) Notice: Subject to any disclaimer, the term of this patent is extended or adjusted under 35 U.S.C. 154(b) by 0 days.

This patent is subject to a terminal disclaimer.

(21) Appl. No.: 11/140,719

(22) Filed: May 31, 2005

(65) Prior Publication Data

US 2005/0279260 A1 Dec. 22, 2005

Related U.S. Application Data

(63) Continuation-in-part of application No. 10/963,919, filed on Oct. 13, 2004, now Pat. No. 6,931,999, and a continuation-in-part of application No. 10/409,259, filed on Apr. 8, 2003, which is a continuation of application No. 10/385,385, filed on Mar. 10, 2003, now Pat. No. 6,832,563, which is a continuation of application No. 10/097,104, filed on Mar. 12, 2002, now Pat. No. 6,530,331, which is a continuation of application No. 09/635,303, filed on Aug. 9, 2000, now Pat. No. 6,431,092, which is a continuation-in-part of application No. 09/228,326, filed on Jan. 11, 1999, now Pat. No. 6,112,674, which is a continuation-in-part of application No. 29/095,375, filed on Oct. 21, 1998, now Pat. No. Des. 414,626.

(60) Provisional application No. 60/576,223, filed on Jun. 1, 2004, provisional application No. 60/371,486, filed on Apr. 9, 2002.

(51) Int. Cl.
*A47B 3/00* (2006.01)

(52) U.S. Cl. ..... 108/132; 108/129

(58) Field of Classification Search ..... 108/132, 108/129, 35, 36, 115, 901, 902
See application file for complete search history.

(56) References Cited

U.S. PATENT DOCUMENTS 236,197 A 1/1881 Valley (Continued)

FOREIGN PATENT DOCUMENTS

AU 223700 5/1958

(Continued)

OTHER PUBLICATIONS

Correll's Answer to Amended Complaint, 7 pages, Oct. 15, 2003. *Lifetime Products, Inc.* v. *Correll, Inc.*, et al. Case No.: 2:02 CV 01366 (D. Utah).

(Continued)

*Primary Examiner*—Jose V. Chen

(57) ABSTRACT

A table may include a table top and one or more legs, which may be movable between an extended and a collapsed position relative to the table top. The table may also include one or more securing members that are sized and configured to receive at least a portion of the one or more legs in the collapsed position. Additionally, the table may include one or more mounting members that are sized and configured to receive another portion of the table such as a cross bar. Advantageously, the securing members and mounting members may be attached to the table top by a snap, friction or interference fit, which may allow the securing members and mounting members to be attached to the table top at any time during the manufacturing process. It may also allow the table to be used with different types of securing members, mounting members and legs. In addition, it may allow the securing members and mounting members to be replaced, if desired.

17 Claims, 7 Drawing Sheets

U.S. PATENT DOCUMENTS

| | | | |
|---|---|---|---|
| 236,741 | A | 1/1881 | Weaver |
| 769,354 | A | 9/1904 | Nielseri |
| 1,063,642 | A | 6/1913 | Birdsall |
| 1,165,991 | A | 12/1915 | Maggs |
| 1,266,929 | A | 5/1918 | Enis |
| 1,272,187 | A | 7/1918 | Basford |
| 1,296,336 | A | 3/1919 | Stine |
| 1,351,013 | A | 8/1920 | Stine |
| 1,514,418 | A | 11/1924 | Battenfeld |
| 1,594,572 | A | 8/1926 | Soltesz |
| 1,659,840 | A | 2/1928 | Smith |
| 1,757,260 | A | 5/1930 | Silverman |
| 1,765,766 | A | 6/1930 | Lyon |
| 1,823,484 | A | 9/1931 | Blumenthal |
| 1,836,934 | A | 12/1931 | Morecroft |
| 1,836,943 | A | 12/1931 | Temple |
| 1,888,117 | A | 11/1932 | Fox |
| 1,956,946 | A | 5/1934 | Duffy |
| 2,109,869 | A | 3/1938 | Ross |
| 2,257,550 | A | 9/1941 | Gay |
| 2,278,810 | A | 4/1942 | Virtue |
| 2,326,461 | A | 8/1943 | Howe |
| 2,411,658 | A | 11/1946 | La Rue |
| 2,452,169 | A | 10/1948 | Wells |
| 2,470,869 | A | 5/1949 | Schmidt |
| 2,512,473 | A | 6/1950 | Alch |
| 2,522,642 | A | 9/1950 | Schmidt |
| 2,524,198 | A | 10/1950 | La Rue |
| 2,548,682 | A | 4/1951 | Price |
| 2,558,465 | A | 6/1951 | Seymour |
| 2,568,622 | A | 9/1951 | Hagan |
| 2,579,934 | A | 12/1951 | Krasney |
| 2,583,247 | A | 1/1952 | Aja et al. |
| 2,621,710 | A | 12/1952 | Miller |
| 2,647,562 | A | 8/1953 | Hoffar |
| 2,661,792 | A | 12/1953 | Lysaght |
| 2,670,031 | A | 2/1954 | Melges |
| 2,689,158 | A | 9/1954 | Mahr |
| 2,690,210 | A | 9/1954 | Holick |
| 2,717,028 | A | 9/1955 | Villemune |
| 2,717,631 | A | 9/1955 | Howe |
| 2,722,971 | A | 11/1955 | Gallagher et al. |
| 2,748,837 | A | 6/1956 | Beller |
| 2,752,987 | A | 7/1956 | Smithers |
| 2,756,082 | A | 7/1956 | Pucci |
| 2,766,812 | A | 10/1956 | Schrader |
| 2,771,937 | A | 11/1956 | Wilson |
| 2,780,506 | A | 2/1957 | Howe |
| 2,788,059 | A | 4/1957 | Mackintosh |
| 2,800,379 | A | 7/1957 | Smithers |
| 2,805,708 | A | 8/1957 | Bohn |
| 2,811,197 | A | 10/1957 | Nimmo |
| 2,811,400 | A | 10/1957 | James |
| 2,825,390 | A | 3/1958 | Post |
| 2,831,688 | A | 4/1958 | Knox |
| 2,837,141 | A | 6/1958 | Shore |
| 2,849,053 | A | 8/1958 | Beller et al. |
| 2,878,589 | A | 3/1959 | Howe et al. |
| 2,936,820 | A | 5/1960 | Blink et al. |
| 2,939,516 | A | 6/1960 | Drew |
| 2,959,209 | A | 11/1960 | Lakin |
| 2,964,368 | A | 12/1960 | Heyer |
| 2,978,754 | A | 4/1961 | Wilson |
| 2,983,308 | A | 5/1961 | Horowitz |
| 2,992,043 | A | 7/1961 | Nelson |
| 2,999,729 | A | 9/1961 | Semmelroth |
| 3,025,120 | A | 3/1962 | Howe |
| 3,027,209 | A | 3/1962 | Nielsen |
| 3,030,728 | A | 4/1962 | Wesman |
| 3,041,775 | A | 7/1962 | Brown, Jr. et al. |
| 3,079,197 | A | 2/1963 | Mugler |
| 3,080,193 | A | 3/1963 | Nimmo |
| 3,093,924 | A | 6/1963 | Pompa |
| 3,096,866 | A | 7/1963 | Glass |
| 3,101,062 | A | 8/1963 | Kanzelberger |
| 3,112,954 | A | 12/1963 | Kanitz |
| 3,141,424 | A | 7/1964 | Seymour |
| 3,143,982 | A | 8/1964 | Blink et al. |
| 3,144,236 | A | 8/1964 | Clanin |
| 3,166,029 | A | 1/1965 | Acton |
| 3,174,796 | A | 3/1965 | Brown |
| 3,191,991 | A | 6/1965 | Anderson et al. |
| 3,256,037 | A | 6/1966 | Giambalvo |
| 3,259,426 | A | 7/1966 | Shaw et al. |
| 3,267,886 | A | 8/1966 | Glass |
| 3,273,936 | A | 9/1966 | Deavers |
| 3,276,815 | A | 10/1966 | Cardy |
| 3,337,262 | A | 8/1967 | Katzfey et al. |
| 3,349,728 | A | 10/1967 | Barecki et al. |
| 3,353,867 | A | 11/1967 | Anderson |
| 3,357,729 | A | 12/1967 | Krueger |
| 3,410,232 | A | 11/1968 | Krueger |
| 3,429,283 | A | 2/1969 | Uhor |
| 3,439,634 | A | 4/1969 | Bender |
| 3,545,738 | A | 12/1970 | Stagg |
| 3,574,393 | A | 4/1971 | Hughes |
| 3,580,632 | A | 5/1971 | Seymour |
| 3,635,432 | A | 1/1972 | Hollander |
| 3,650,560 | A | 3/1972 | Wohlk |
| 3,672,719 | A | 6/1972 | Haukedahl |
| 3,692,358 | A | 9/1972 | Sung |
| 3,718,306 | A | 2/1973 | Murray |
| 3,731,971 | A | 5/1973 | Sjogren |
| 3,762,626 | A | 10/1973 | Dorsey |
| 3,765,719 | A | 10/1973 | Silver |
| 3,769,920 | A | 11/1973 | Weiss |
| 3,788,696 | A | 1/1974 | Loewen |
| 3,797,884 | A | 3/1974 | Gutierrez |
| 3,857,343 | A | 12/1974 | Greenberg |
| 3,885,829 | A | 5/1975 | Haeger |
| 3,893,400 | A | 7/1975 | Grant |
| 3,905,478 | A | 9/1975 | Peterson et al. |
| 3,922,408 | A | 11/1975 | Smith |
| 3,960,354 | A | 6/1976 | Simikoski |
| 3,994,527 | A | 11/1976 | Nikitits et al. |
| 4,040,658 | A | 8/1977 | Mayol |
| 4,043,277 | A | 8/1977 | Wallace |
| 4,047,754 | A | 9/1977 | Cathey |
| 4,052,100 | A | 10/1977 | Nikitits et al. |
| 4,060,275 | A | 11/1977 | Hansen |
| 4,064,812 | A | 12/1977 | Commanda |
| 4,064,815 | A | 12/1977 | Baum |
| 4,070,057 | A | 1/1978 | Jones |
| 4,072,231 | A | 2/1978 | Helms |
| 4,111,482 | A | 9/1978 | Jones |
| 4,131,311 | A | 12/1978 | Nikitits et al. |
| 4,157,089 | A | 6/1979 | Loughrey |
| 4,191,111 | A | 3/1980 | Emmert |
| RE30,274 | E | 5/1980 | Bolon et al. |
| 4,249,773 | A | 2/1981 | Giambalvo |
| 4,289,350 | A | 9/1981 | Thomas et al. |
| 4,313,385 | A | 2/1982 | Fitzgerald |
| 4,330,151 | A | 5/1982 | Healey |
| 4,382,627 | A | 5/1983 | Dean |
| 4,415,199 | A | 11/1983 | Wright |
| 4,438,603 | A | 3/1984 | Durkan, Jr. |
| 4,462,636 | A | 7/1984 | Markson |
| 4,471,969 | A | 9/1984 | Zabala et al. |
| 4,489,661 | A | 12/1984 | Fitzgerald |
| 4,537,443 | A | 8/1985 | Bray |
| 4,538,526 | A | 9/1985 | Seeley |
| 4,557,200 | A * | 12/1985 | Geschwender ..... 108/132 |
| 4,572,574 | A | 2/1986 | Fischhaber et al. |
| 4,596,196 | A | 6/1986 | Gunter et al. |

| | | | | |
|---|---|---|---|---|
| 4,606,575 | A | 8/1986 | Kodet | |
| 4,609,192 | A | 9/1986 | Bratcher | |
| 4,648,652 | A | 3/1987 | Van Kuren | |
| 4,653,804 | A | 3/1987 | Yoo et al. | |
| 4,700,987 | A | 10/1987 | Sraka et al. | |
| 4,740,032 | A | 4/1988 | Olsen et al. | |
| 4,744,309 | A | 5/1988 | Kiesel et al. | |
| 4,759,296 | A | 7/1988 | Simpson | |
| 4,762,321 | A | 8/1988 | Chang | |
| 4,815,394 | A | 3/1989 | Ettlinger et al. | |
| 4,817,902 | A | 4/1989 | Mason | |
| 4,822,066 | A | 4/1989 | Rehrig | |
| 4,826,244 | A | 5/1989 | Choi | |
| 4,834,450 | A | 5/1989 | Stickler | |
| 4,841,877 | A | 6/1989 | Virtue | |
| 4,841,879 | A | 6/1989 | Ferguson | |
| 4,864,941 | A | 9/1989 | Goulter | |
| 4,883,314 | A | 11/1989 | Sakong | |
| 4,903,686 | A | 2/1990 | Jennings | |
| 4,951,576 | A | 8/1990 | Cobos et al. | |
| 4,960,303 | A | 10/1990 | York | |
| 4,998,395 | A | 3/1991 | Bezner | |
| 5,007,673 | A | 4/1991 | Cheng | |
| 5,009,170 | A | 4/1991 | Spehar | |
| 5,014,628 | A | 5/1991 | Roberts | |
| 5,018,785 | A | 5/1991 | Monson et al. | |
| 5,029,938 | A | 7/1991 | Song | |
| 5,060,902 | A | 10/1991 | Hartman | |
| 5,070,664 | A | 12/1991 | Groh et al. | |
| 5,109,778 | A | 5/1992 | Berkowitz et al. | |
| 5,149,575 | A | 9/1992 | Soifer | |
| 5,208,084 | A | 5/1993 | Rutz | |
| 5,240,307 | A | 8/1993 | Jones et al. | |
| 5,271,338 | A | 12/1993 | Bonham | |
| 5,279,233 | A | 1/1994 | Cox | |
| 5,284,100 | A | 2/1994 | Thorn | |
| 5,314,231 | A | 5/1994 | Otterbacher | |
| 5,323,713 | A | 6/1994 | Luyk et al. | |
| 5,325,793 | A | 7/1994 | Martin | |
| 5,335,594 | A | 8/1994 | Karlyn et al. | |
| D350,862 | S | 9/1994 | Beller | |
| 5,357,872 | A * | 10/1994 | Wilmore | 108/132 |
| 5,377,601 | A | 1/1995 | Cashen | |
| 5,394,808 | A | 3/1995 | Dutro et al. | |
| 5,409,245 | A | 4/1995 | Kern et al. | |
| 5,411,314 | A | 5/1995 | Wallace | |
| 5,421,272 | A | 6/1995 | Wilmore | |
| 5,440,857 | A | 8/1995 | Shanok et al. | |
| 5,443,020 | A | 8/1995 | Price | |
| 5,483,901 | A | 1/1996 | Tisbo | |
| 5,488,926 | A | 2/1996 | Hunt | |
| 5,505,142 | A | 4/1996 | Fink | |
| 5,528,997 | A | 6/1996 | Miller | |
| 5,536,552 | A | 7/1996 | Scripsick | |
| 5,622,120 | A | 4/1997 | Yeh | |
| 5,623,882 | A | 4/1997 | Price | |
| 5,626,339 | A | 5/1997 | Schickert et al. | |
| 5,636,578 | A | 6/1997 | Rizzi | |
| 5,638,761 | A | 6/1997 | Berkowitz et al. | |
| 5,678,491 | A | 10/1997 | Price et al. | |
| 5,694,865 | A | 12/1997 | Raab | |
| 5,730,066 | A | 3/1998 | Auten et al. | |
| 5,732,637 | A | 3/1998 | Raab | |
| 5,860,367 | A | 1/1999 | Riegel et al. | |
| 5,865,128 | A | 2/1999 | Tarnay | |
| 5,868,081 | A | 2/1999 | Raab | |
| 5,909,021 | A | 6/1999 | Duffy | |
| 5,921,623 | A | 7/1999 | Nye et al. | |
| 5,947,037 | A | 9/1999 | Hornberger et al. | |
| D414,626 | S | 10/1999 | Collins et al. | |
| 5,983,807 | A | 11/1999 | Tarnay et al. | |
| 5,984,047 | A | 11/1999 | Rogers | |
| 6,000,345 | A | 12/1999 | Gillotti | |
| D419,332 | S | 1/2000 | Collins et al. | |
| D420,527 | S | 2/2000 | Pinch et al. | |
| 6,032,585 | A | 3/2000 | Pinch | |
| D423,258 | S | 4/2000 | Pinch | |
| 6,058,853 | A | 5/2000 | Pinch | |
| 6,058,854 | A | 5/2000 | Tarnay et al. | |
| 6,076,472 | A | 6/2000 | Lloyd | |
| 6,086,148 | A | 7/2000 | Gatto et al. | |
| 6,109,687 | A | 8/2000 | Nye et al. | |
| 6,112,674 | A | 9/2000 | Stanford | |
| D442,788 | S | 5/2001 | Nye et al. | |
| 6,334,400 | B1 | 1/2002 | Nien | |
| 6,347,831 | B1 | 2/2002 | Nye et al. | |
| 6,371,034 | B1 | 4/2002 | Simpson et al. | |
| 6,374,756 | B1 | 4/2002 | Fieldwick et al. | |
| 6,422,157 | B2 | 7/2002 | Rumph | |
| 6,431,092 | B1 | 8/2002 | Stanford | |
| 6,443,521 | B1 | 9/2002 | Nye et al. | |
| 6,508,184 | B1 | 1/2003 | Winter et al. | |
| 6,520,094 | B2 * | 2/2003 | Wen | 108/132 |
| 6,530,331 | B2 | 3/2003 | Stanford | |
| 6,550,404 | B2 | 4/2003 | Stanford | |
| 6,651,568 | B1 * | 11/2003 | Buono | 108/132 |
| 6,655,301 | B2 | 12/2003 | Stanford | |
| 6,666,152 | B2 | 12/2003 | Tsai | |
| D489,557 | S | 5/2004 | Strong et al. | |
| 6,832,563 | B2 | 12/2004 | Stanford | |
| 6,848,370 | B1 | 2/2005 | Stanford | |
| 6,895,872 | B2 | 5/2005 | Stanford | |
| 6,915,748 | B2 | 7/2005 | Stanford | |
| 7,069,865 | B2 * | 7/2006 | Strong et al. | 108/132 |
| 2003/0127028 | A1 | 7/2003 | Baik et al. | |
| 2003/0177962 | A1 | 9/2003 | Stanford | |
| 2003/0233967 | A1 | 12/2003 | Lin | |
| 2004/0099189 | A1 | 5/2004 | Stanford | |
| 2004/0187747 | A1 | 9/2004 | Shenghao et al. | |
| 2004/0187748 | A1 | 9/2004 | Shenghao et al. | |
| 2004/0194675 | A1 | 10/2004 | Shenghao et al. | |
| 2004/0237856 | A1 | 12/2004 | Shenghao et al. | |
| 2004/0244656 | A1 | 12/2004 | Shenghao et al. | |
| 2005/0045075 | A1 | 3/2005 | Stanford | |
| 2005/0045076 | A1 | 3/2005 | Stanford | |

FOREIGN PATENT DOCUMENTS

| | | |
|---|---|---|
| BE | 650758 | 11/1964 |
| CA | 2166651 | 7/1996 |
| DE | 341007 | 5/1920 |
| DE | 3705566 | 9/1988 |
| EP | 0572331 | 12/1933 |
| FR | 2553644 | 4/1985 |
| FR | 2637474 | 4/1990 |
| GB | 10007 | 5/1908 |
| GB | 1457271 | 11/1976 |
| GB | 1595210 | 8/1981 |
| JP | 09065934 | 3/1977 |
| JP | H10-75825 | 3/1998 |
| TW | 320006 | 3/1997 |
| WO | WO 95/10204 | 4/1995 |

OTHER PUBLICATIONS

[Proposed] Amendment, 74 pages (including Exhibits A-C), Sep. 23, 2003. *Lifetime Products, Inc.* v. *Correll, Inc.*, et al. Case No.: 2:02 CV 01366 TC (D. Utah).

Complaint for: (1) Patent Infringement; and (2) Inducement of Patent Infringement, Demand for Jury Trial, 28 pages (including Exhibit A), Aug. 13, 2002. *Lifetime Products, Inc.* v. *Correll, Inc.* Case No.: SA02-763 GLT (MLGx), (D. Utah).

Correll, Inc.'s Answer, 8 pages, Sep. 9, 2002. *Lifetime Products, Inc.* v. *Correll, Inc.* Case No.: SA02-763 GLT (MLGx), (D. Utah).

Civil Docket for Case #: 03-CV-13, 7 pages, May 7, 2004. *FDL, Inc.* v. *Lifetime Products, Inc.* Case No.: 1:03 CV 0013 TC (D. Utah).

Complaint for Declaratory Judgment, 26 pages (including Exhibit A), Jan. 27, 2003. *FDL, Inc*. v. *Lifetime Products, Inc*. Case No.: 1:03 CV 0013 TC (D. Utah).
Lifetime's Answer and Counterclaim, 56 pages (including Exhibits A-B), Mar. 24, 2003. *FDL, Inc*. v. *Lifetime Products, Inc*. Case No.: 1:03 CV 0013 TC (D. Utah).
Lifetime's Amended Answer and Counterclaim, 67 pages (including Exhibits A-C), Mar. 27, 2003. *FDL, Inc*. v. *Lifetime Products, Inc*. Case No.: 1:03 CV 0013 TC (D. Utah).
FDL's Reply to Lifetime's Second Amended Counterclaim and FDL's Counterclaim, 51 pages (including Exhibits A-B), Jun. 9, 2003. *FDL, Inc*. v. *Lifetime Products, Inc*. Case No.: 1:03 CV 0013 TC (D. Utah).
Lifetime's Answer to FDL's Counterclaim in Reply, 4 pages, Aug. 13, 2003. *FDL, Inc*. v. *Lifetime Products, Inc*. Case No.: 1:03 CV 0013 TC (D. Utah).

* cited by examiner

TABLE WITH RECEIVING MEMBERS

CROSS-REFERENCE TO RELATED APPLICATIONS

This application claims priority to and the benefit of U.S. provisional patent application Ser. No. 60/576,223, filed Jun. 1, 2004.

This application is a continuation-in-part of U.S. patent application Ser. No. 10/409,259, filed Apr. 8, 2003; which claims priority to and the benefit of U.S. provisional patent application Ser. No. 60/371,486, filed Apr. 9, 2002.

This application is also a continuation-in-part of Ser. No. 10/963,919 filed Oct. 13, 2004, now U.S. Pat. No. 6,931, 999, entitled PORTABLE FOLDING UTILITY TABLE WITH INTEGRAL RECEIVING MEMBERS, which issued on Aug. 23, 2005; which is a continuation of Ser. No. 10/385,385 filed Mar. 10, 2003, now U.S. Pat. No. 6,832, 563, entitled PORTABLE FOLDING UTILITY TABLE WITH INTEGRAL RECEIVING MEMBERS, which issued on Dec. 21, 2004; which is a continuation of Ser. No. 10/097,104, filed Mar. 12, 2002, now U.S. Pat. No. 6,530, 331, entitled PORTABLE FOLDING UTILITY TABLE WITH INTEGRAL RECEIVING MEMBERS, which issued on Mar. 11, 2003; which is a continuation of Ser. No. 09/635,303, filed Aug. 9, 2000, now U.S. Pat. No. 6,431, 092, entitled PORTABLE FOLDING UTILITY TABLE WITH CENTER SUPPORT ASSEMBLY, which issued on Aug. 13, 2002; which is a continuation-in-part of Ser. No. 09/228,326, filed Jan. 11, 1999, now U.S. Pat. No. 6,112, 674, entitled PORTABLE FOLDING UTILITY TABLE WITH CENTER SUPPORT ASSEMBLY, which issued on Sep. 5, 2000; which is a continuation-in-part of Ser. No. 29/095,372 filed Oct. 21, 1998, now U.S. Pat. No. D414, 626, entitled UTILITY TABLE, which issued on Oct. 5, 1999.

Each of these patents and applications are incorporated by reference in their entireties.

BACKGROUND OF THE INVENTION

1. Field of the Invention

The present invention generally relates to furniture and, in particular, to tables.

2. Description of Related Art

Conventional tables typically include one or more legs that are connected to a table top. Many conventional tables include folding legs to allow the table to be more easily transported and stored. In particular, conventional tables often include legs that are pivotally attached to the table top to allow the legs to be moved between an extended position in which the legs extend outwardly from the table top and a collapsed or storage position in which the legs are positioned near or adjacent to the table top. Thus, when the table is desired to be used, the legs can be placed in the extended position. On the other hand, when the table is desired to be transported or stored, the legs can be placed in the collapsed or storage position.

The table tops of many conventional tables with folding legs are frequently constructed from materials such as metal or wood. In particular, these known table tops may be constructed from steel, aluminum, plywood, particle board, fiber board and other types of wooden laminates. Conventional table tops constructed from wood or metal, however, are often relatively heavy and this may make the table awkward or difficult to move. Table tops constructed from wood or metal are also relatively expensive and the table tops must generally be treated or finished before use. For example, conventional table tops constructed from wood are often sanded and/or painted, and table tops constructed from metal must be formed or cut into the desired shape and painted or otherwise finished. In addition, many wooden table tops include a vinyl cover, which may undesirably increase the costs of the table and may be difficult to repair if damaged.

Conventional table tops constructed from materials such as plywood, particle board, fiber board or wooden laminates are often not very strong or rigid. These known types of tables typically cannot support large or heavy items, and these types of tables generally cannot withstand large forces or impacts without breaking or cracking. For example, the wooden table tops may split or shatter, or the legs may become disconnected from the table top.

In addition, conventional tables with table tops constructed from wood or metal may be relatively heavy, which may make the table more difficult to move and more expensive to ship and transport. In order to decrease the weight of these tables, it is known to construct the table tops from lightweight materials such as plastic. In particular, known tables may include table tops constructed from injection molded plastic to form relatively thin, lightweight table tops. Disadvantageously, these lightweight table tops frequently require reinforcing members or other structural parts, such as brackets or support members, to strengthen the table top. While these additional parts may increase the strength of the table top, they may undesirably increase the weight and complexity of the table. In addition, these additional parts may increase manufacturing costs and require additional time to assemble the table.

BRIEF SUMMARY OF PREFERRED EMBODIMENTS OF THE INVENTION

A need therefore exists for a table that eliminates or diminishes the above-described disadvantages and problems.

One aspect is a table that may include one or more receiving members. The receiving members, for example, may be sized and configured to receive a portion of the table such as a table leg. Desirably, the receiving members are sized and configured to allow the table legs to be selectively received. The receiving members may also be sized and configured to receive and retain the table legs in a generally fixed position. The receiving members could also be sized and configured to receive and/or retain other portions of the table such as the frame, cross bars, braces and the like.

Another aspect is a table that may include one or more table legs that can be moved between an extended or use position and a collapsed or storage position. When the legs are in the extended or use position, then the legs may support a table top above a surface such as the floor. On the other hand, when the legs are in the collapsed or storage position, then the table may be easier to move and/or transport.

A further aspect is a table that may include one or more receiving members that are sized and configured to receive at least a portion of the legs in the collapsed or storage position. In particular, the receiving members are preferably sized and configured to receive and retain the legs in the collapsed or storage position. The receiving members are also preferably sized and configured to allow the legs to be selectively removed so that the legs can be moved between the extended and collapsed positions. Thus, the receiving members may receive and retain the legs in the collapsed or storage position, and allow the legs to be moved between the extended and collapsed positions.

Yet another aspect is a table that may include one or more pairs of receiving members that are sized and configured to receive at least a portion of the legs in the collapsed or storage position. For example, two receiving members could be sized and configured to receive the same leg in the collapsed or storage position. Advantageously, the receiving members could be placed adjacent to each other, on opposing sides of the leg, in a spaced apart position or other suitable positions.

Still another aspect is a table that may include one or more receiving members, which are separate and distinct components from the table, that are subsequently attached to a suitable portion of the table. For example, the receiving members may be attached to the table by receiving portions. In particular, the table top may include one or more receiving portions that are sized and configured to attach the one or more receiving members to the table top. Significantly, the receiving portions may be integrally formed in the table top as part of a unitary, one-piece structure. In addition, the receiving members may be attached to the receiving portions by a snap fit, friction fit, interference fit, fasteners, adhesives and the like.

Because the receiving members may be selectively attached to the table, that may increase the potential uses and functionality of the table, and may allow the table to be more economically manufactured. For example, the table may be more economically manufactured if the receiving members may be attached at any desired time during the manufacturing process. This may also allow consumers to attach and/or replace the receiving members. In addition, this may allow different types, sizes and designs of receiving members to be used in connection with the same table, which may allow the table to be used with different types and combinations of legs, frames, cross bars and other components. Thus, for instance, the same table top may be used with one type of legs and receiving members in one configuration and a different type of legs and receiving members in another configuration. It will be appreciated, however, that the receiving members do not have to be attached to the table.

Another aspect is a table that may include one or more receiving members that are sized and configured to receive and retain the legs in the collapsed or storage position by deforming, bending or deflecting. In particular, the receiving members preferably deform, bend or deflect to allow the leg to be moved into the collapsed position. The receiving members preferably elastically or resiliently return to their original configuration to retain the leg in the collapsed position. Advantageously, the receiving members may also allow the legs to be selectively received and retained in the collapsed or storage position, which may allow the legs to be moved between the use and storage positions.

A further aspect is a table that may include a table top constructed from plastic. The table top is preferably constructed using a blow-molding process, which may allow a lightweight table top to be formed and it may allow the table top to have various desired configurations, shapes, sizes and designs. This may also allow a table top to be constructed that is generally weather resistant and temperature insensitive, which may allow the table to be used in a wide variety of locations and environments. In addition, this may allow a table top that is durable, long-lasting and corrosion resistant to be constructed. Further, because a table top constructed from blow-molded plastic may be relatively strong, the table may be used to support a relatively large amount of weight. Advantageously, the blow-molded plastic table top may form a structural member of the table and/or the table top may be supported by other structures, such as brackets or a frame.

Advantageously, a table top constructed from blow-molded plastic may be relatively strong because it may include opposing walls or surfaces that are separated by a distance. Preferably, the opposing walls are separated by a generally constant distance, but the walls may be separated by any suitable distance. In addition, because the table top may include a hollow interior portion that is formed during the blow-molding process, that may create a lightweight table top. The plastic table top, however, could also be constructed from other suitable processes such as injection molding, rotary molding, compression molding and the like. In addition, the table top could be constructed from other suitable materials such as synthetics, composites and the like.

A still further aspect is a table that may include one or more receiving members that are constructed from plastic. Preferably, the receiving members are constructed from injection molded plastic, which may allow the receiving members to be quickly and easily manufactured. The receiving members could also be constructed from other suitable processes such as blow-molding, rotary molding, compression molding and the like, and the receiving members could be constructed from other suitable materials such as synthetics, composites and the like.

Yet another aspect is a table that may include a table top constructed from one type of plastic and/or process, and one or more receiving members that are constructed from another type of plastic and/or process. For example, the table top is preferably formed from blow-molded plastic and the receiving members are preferably formed from injection molded plastic. The receiving members are then selectively or permanently attached to the table top. It will be appreciated that the receiving members and table top could also be constructed from any suitable materials and/or processes.

Another aspect is a table that may include a table top constructed from plastic and including a hollow interior portion that is formed during the blow-molding process. A leg assembly may be movable between a collapsed position and an extended position relative to the table top. The table may also include a first receiving portion and a first receiving member that is sized and configured to be selectively connected to the first receiving portion. The first receiving member is preferably sized and configured to receive and retain at least a portion of the leg assembly when the leg assembly is in the collapsed position.

Still another aspect is a table that may include a table top formed via a first manufacturing process and a leg assembly movable relative to the table top between a collapsed position and an extended position. The table may also include a first receiving portion and a first receiving member that is sized and configured to be selectively connected to the first receiving portion. The first receiving member is preferably sized and configured to receive and retain at least a portion of the leg assembly when the leg assembly is in the collapsed position. In addition, the first receiving member is preferably formed via a second, different manufacturing process than the table top.

Yet another aspect is a table that may include a table top and a leg assembly that is movable between a collapsed position and an extended position relative to the table top. The table may also include a first receiving member that is selectively connected to the table top, the first receiving member being sized and configured to receive and retain at least a portion of the leg assembly when the leg assembly is in the collapsed position. The first receiving member may include a base and one or more attachment portions that are sized and configured to be connected the table top.

These and other aspects, features and advantages of the invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards tables. The principles of the present invention, however, are not limited to tables. It will be understood that, in light of the present disclosure, the invention disclosed herein can be successfully used in connection with other types of furniture, fixtures, and equipment.

Additionally, to assist in the description of the table, words such as top, bottom, front, rear, right and left may be used to describe the accompanying figures. It will be appreciated, however, that the table can be located in a variety of desired positions—including various angles, sideways and even upside down. A detailed description of the table now follows.

Figure 1:
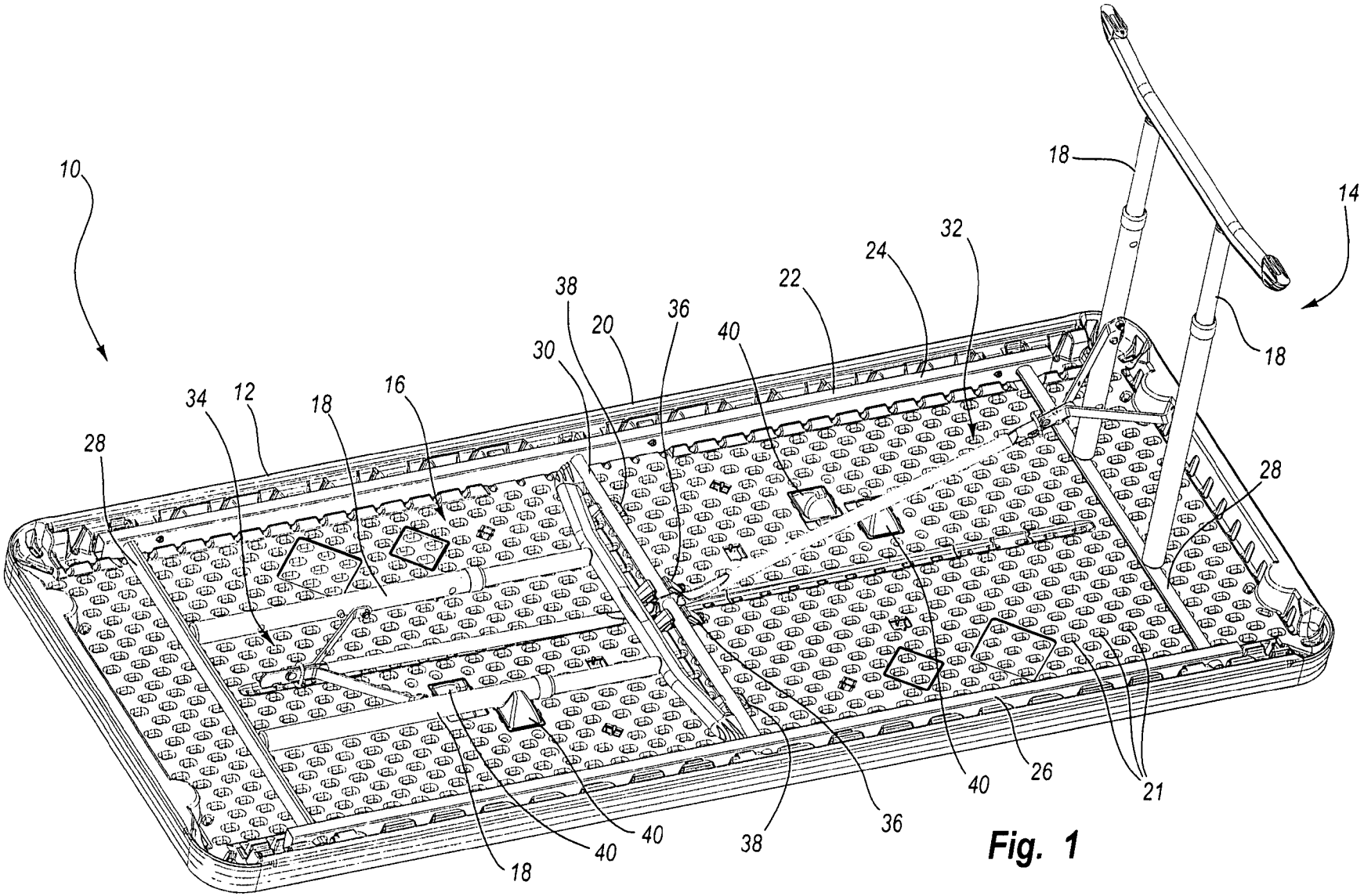
FIG. 1 is a lower perspective view of an exemplary table, illustrating exemplary receiving members.
Figure 2:
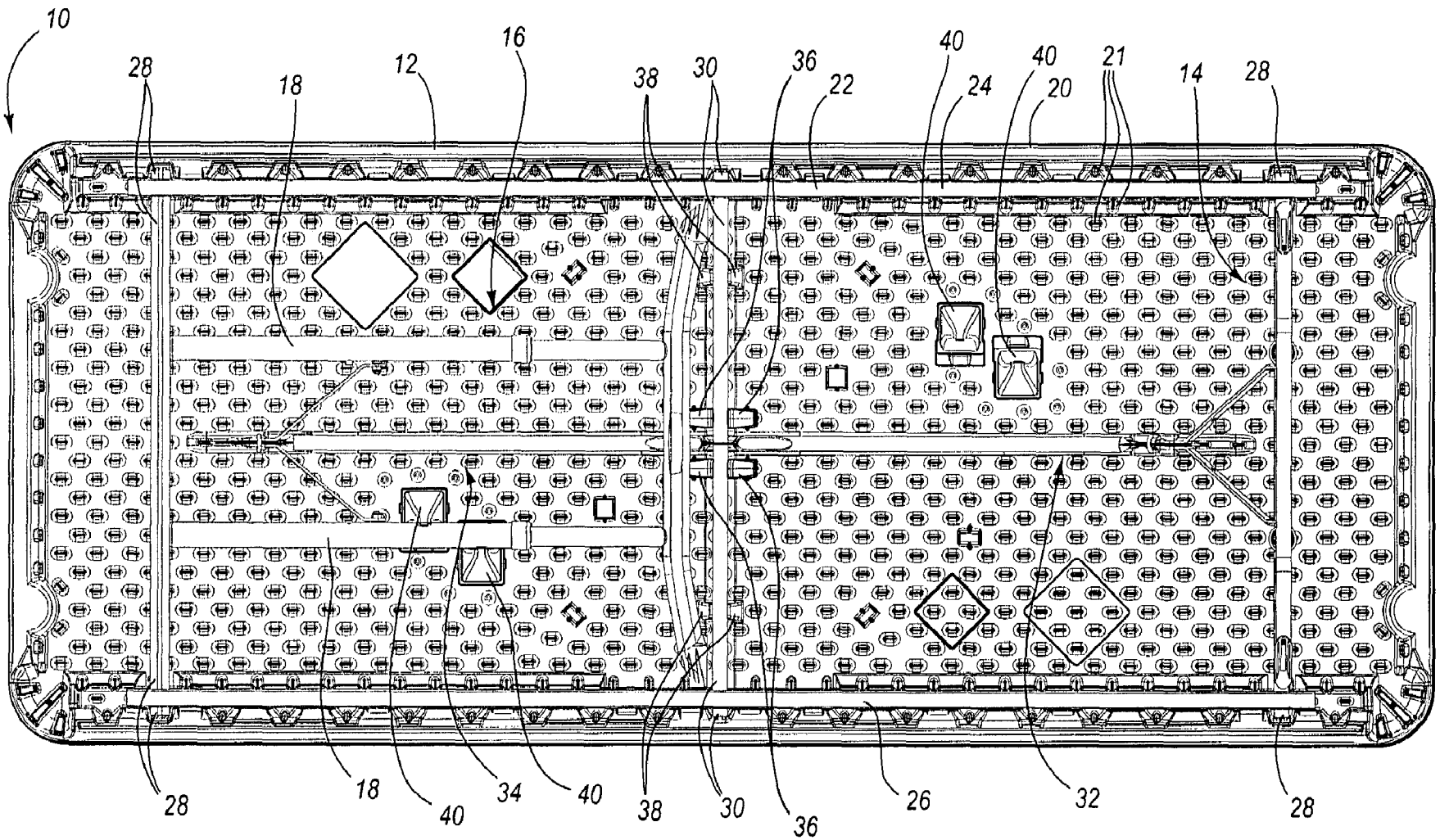
FIG. 2 is bottom view of the table shown in FIG. 1.
Figure 6:
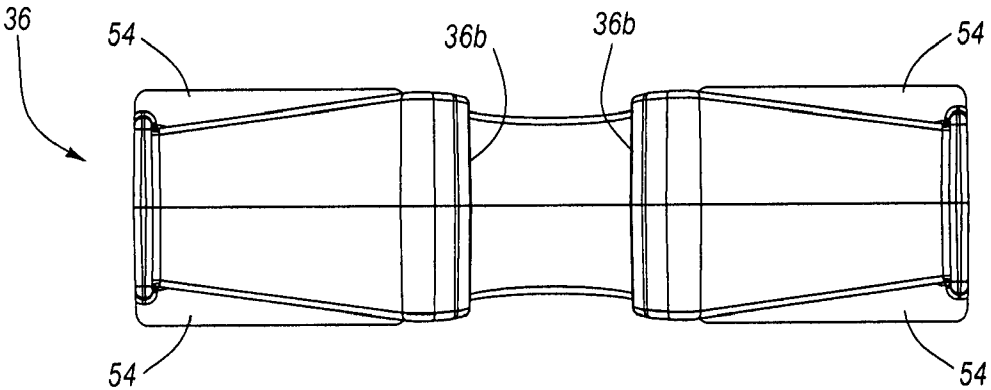
FIG. 6 is a top view of the receiving member shown in FIG. 3.

As shown in FIGS. 1-2, an exemplary embodiment of a table 10 includes a table top 12 with a first leg assembly 14 and a second leg assembly 16 that may be used to support the table top above a surface such as the floor. The first and second leg assemblies 14, 16 may include one or more legs 18. For example, as shown in the accompanying figures, the first and second leg assembles 14, 16 could include two legs 18 that are interconnected. The leg assemblies 14, 16 could also include only a single leg 18, if desired. In addition, the leg assemblies 14, 16 could include any suitable number and configuration of legs 18, and the leg assemblies may include other suitable parts and components depending, for example, upon the design of the leg assemblies. Thus, for example, the leg assemblies 14, 16 may consist of only a single leg 18 or the leg assemblies may include one or more legs and other parts or components such as connecting members, feet, and the like. One of ordinary skill in the art will appreciate that the leg assemblies 14, 16 and legs 18 may have a variety of suitable shapes and sizes, and the leg assemblies and/or legs may have a fixed or adjustable length.

As shown in the accompanying figures, the leg assemblies 14, 16 are preferably movable between a collapsed position and an extended position relative to the table top 12. For example, as shown in FIGS. 1-2, the first leg assembly 14 is in the extended position in which the leg assembly extends outwardly from the table top 12, and the second leg assembly 16 is in the collapsed position in which the leg assembly is generally adjacent and parallel to the lower portion of the table top. When the leg assemblies 14, 16 are in the collapsed position, all or a portion of the leg assemblies may contact or abut the lower portion of the table top 12, if desired. Advantageously, this may facilitate shipping and/or stacking of the tables 10. As discussed in greater detail below, the leg assemblies 14, 16 may be pivotally connected to the table top 12, but the leg assemblies may be connected to the table top in any suitable manner.

As shown in FIGS. 1-2, the table top 12 may have a generally rectangular shape. For example, the table top 12 may have a length of about 72 inches (about 1.8 meters) and a width of about 30 inches (about 0.76 meters). Advantageously, this size of table top 12 may be used to form a utility-type table, which may allow the table 10 to be used for a wide variety of purposes and reasons. One of ordinary skill in the art will understand that the table top 12 could also be larger or smaller depending, for example, upon the intended use of the table 10. The table top 12 could also have other suitable configurations such as a generally circular configuration with a diameter of about 30 inches (about 0.76 meters) or a generally square configuration with about 30-inch (about 0.76 meters) sides. The table 10 may include a relatively small table top 12 that is sized and configured for use by an individual. On the other hand, if the table 10 is intended to be used by more than one person, then the table top 12 may have a larger size. Significantly, the table top 12 may be sized and configured for numerous suitable particular purposes and functions, such as a personal table, computer table, game table, bedside table, night stand, television table, utility table, card table, conference table and the like. While the table 10 may be sized and configured for a particular use or activity, the table could also have a general shape, design and/or configuration to allow it to be used in a variety of situations and circumstances.

The table top 12 is preferably constructed from a lightweight material and, more preferably, the table top is constructed from plastic, such as high density polyethylene. The plastic table top 12 is desirably formed by a blow-molding process because, for example, the blow-molding process may allow a strong, lightweight, rigid and sturdy table top to be quickly and easily manufactured. Advantageously, a blow-molded plastic table top 12 may have a lighter weight than a conventional table top, which may allow the table 10 to be more easily moved, transported and stored. The blow-molded plastic table top 12 may also be constructed from less plastic than a conventional plastic table top, and that may reduce manufacturing expenses and consumer costs. In addition, the blow-molded plastic table top 12 may be constructed with thinner outer walls and that may allow the table top to cool more quickly during the manufacturing process. This may decrease the time required to create the table top 12 and may increase the efficiency in which the table 10 is manufactured.

The blow-molded plastic table top 12 may be lightweight because it may include a hollow interior portion that is formed during the blow-molding process. Advantageously, the lightweight table top 12 may allow a lighter weight table 10 to be constructed. The lighter weight table 10 may reduce shipping costs and may allow the consumer to more easily move the table. One of ordinary skill in the art will appreciate that the hollow interior portion formed during the manufacturing process may be subsequently filled with material, such as foam, and that the table top 12 does not have to be formed with a hollow interior portion.

The table top 12 is preferably constructed from blow-molded plastic because blow-molded plastic table tops may be relatively durable, weather resistant, temperature insensitive, corrosion resistant and rust resistant. In addition, blow-molded plastic generally does not deteriorate over time and can be used in a wide variety of environments. One skilled in the art, however, will appreciate that the table top 12 does not have to be constructed from blow-molded plastic and other suitable materials and/or processes can be used to construct the table top depending, for example, upon the intended use of the table 10. Thus, the table top 12 could be constructed from other materials with suitable characteristics, such as, other plastics, composites, synthetics, wood, plywood, particle board, metal, metal alloys, fiberglass, ceramics and the like. Additionally, the table top 12 could be constructed using other suitable processes such as injection molding, extrusion molding, rotary molding and the like.

The table top 12 may include one or more features such as a generally downwardly extending lip 20. Advantageously, the lip 20 may be integrally formed in the table top as part of a unitary, one-piece structure. The lip 20 may be disposed about the outer portion of the table top 12 or the lip may be disposed inwardly from the outer edge of the table top. The table top 12 may also include one or more recesses that are sized and configured to receive at least a portion of the leg assemblies 14, 16 when the leg assemblies are in the collapsed position. For example, as shown in the accompanying figures, a recess may be at least partially formed by the lower portion of the table top 12 and the lip 20. Advantageously, when the leg assemblies 14, 16 are in the collapsed position, the leg assemblies may be partially or completely disposed within the recess.

As discusses above, when the leg assemblies 14, 16 are in the collapsed position, the leg assemblies are preferably positioned generally adjacent and parallel to a lower portion of the table top 12. In addition, all or a portion of the leg assemblies 14, 16 may contact the lower portion of the table top 12 when the leg assemblies are in the collapsed position. Advantageously, when the leg assemblies 14, 16 are in the collapsed position, the leg assemblies may be sized, configured and positioned so that the leg assemblies do not extend beyond a plane that is generally aligned with a lower portion of the lip 20. The leg assemblies 14, 16 may also be sized, configured and positioned so that the leg assembles are at least substantially disposed within an envelope generally defined by the lower portion of the table top 12, the lip 20 and a plane generally aligned with a lower portion of the lip. Advantageously, these configurations may facilitate stacking of the tables 10, which may allow the tables to be more easily shipped and stored.

In greater detail, as shown in the accompanying figures, the lip 20 is preferably disposed about the outer periphery of the table top 12 and it may be generally aligned with the outer edge of the table top. In particular, the lip 20 may include an outer portion that is generally aligned with the outer edge of the table top 12, but the lip could be spaced inwardly if desired. The lip 20 may also include a lower portion with a generally even and level surface. Preferably, the lower portion of the lip 20 is generally aligned in the same plane to facilitate stacking of the table 10. In addition, the lip 20 may include a hollow interior portion and the lip may be integrally formed with the table top 12, for example, during the blow-molding process. Advantageously, this may allow the hollow interior portion of the lip 20 to be formed with the hollow interior portion of the table top 12 during the blow-molding process. This may also allow the hollow interior portion of the lip 20 to be in communication with the hollow interior portion of the table top 12. It will be appreciated, however, that the lip 20 does not have to be integrally formed with the table top 12 and the lip could be formed from other suitable processes and materials. It will also be appreciated that the lip 20 could be a separate component that is attached to the table top 12 and the lip could be disposed about all or only a portion of the table top. Further, it will be appreciated that the lip 20 could have a variety of suitable arrangements and configurations, and the table 10 does not require a lip.

The lip 20 could also include an inner portion and it may be spaced apart from the outer portion of the lip. The inner portion of the lip 20 may include a number of serrations, notches, ribs, struts and the like that are sized and configured to increase the strength, rigidity and/or flexibility of the lip 20. In particular, the inner portion of the lip 20 may include a number of notches, indentations, grooves or other inwardly extending portions to form at least a portion of an uneven or saw-tooth type surface. The inner portion of the lip 20 may also include a number of bumps, humps, protrusions or other outwardly extending portions to form at least a portion of an uneven or saw-tooth type surface. The inner portion of the lip 20 may also contain a combination of inwardly and outwardly portions to form at least a portion of the uneven or saw-tooth type surface. These and other suitable configurations of the lip 20, table top 12 and/or table 10 are disclosed in Assignee's U.S. Pat. No. 7,111,563, entitled EDGE AND CORNER FOR A TABLE TOP, which issued on Sep. 26, 2006; and Assignee's pending U.S. patent application Ser. No. 11/051,933, which was filed on Feb. 4, 2005, entitled EDGE AND CORNER FOR A STRUCTURE CONSTRUCTED FROM BLOW-MOLDED PLASTIC; each of which are incorporated by references in their entirety.

The table top 12 may also include other features such as depressions 21, which are also known as tack-offs or kiss-offs. The depressions 21 may also be integrally formed as part of a unitary one-piece table top 12, such as during the blow-molding process. As shown in FIGS. 1-2, a plurality of depressions 21 may be disposed in the lower surface of the table top 12. The depressions 21 preferably cover at least a substantial portion of the lower surface of the table top 12 and the depressions preferably extend towards and/or contact an opposing surface, such as the upper surface of the table top. For example, depressions 21 may be formed in the lower portion of the table top 12 and the ends of the depressions may contact or abut the inner surface of the upper portion of table top 12 or the ends of the depressions may be spaced from the upper portion of the table top. The depressions 21 may also be formed in a predetermined pattern or array, and the depressions may be placed in a staggered, geometric, random or suitable arrangement. One of ordinary skill in the art will appreciate that the depressions 21 may be formed in any desired portions of the table top 12.

Advantageously, the depressions 21 may be sized and configured to increase the strength and/or structural integrity of the table top 12. For example, it was previously believed that stronger blow-molded plastic structures were created by increasing the thickness of the outer walls and/or adding reinforcement structures such as troughs or ribs. Increasing the number of depressions in a blow-molded plastic structure, however, created the surprising and unexpected result of a stronger structure. In addition, increasing the number of depressions created the surprising and unexpected result that the thickness of the outer walls may be reduced, which may allow a structure to be constructed with less plastic. Surprisingly, increasing the number of depressions increased the strength and structural integrity of the structure despite forming additional disruptions and discontinuities in the structure. These surprising and unexpected results allow the table top 12 to be constructed with less plastic even though the lower surface of the table top includes a greater number of disruptions and discontinuities created by the depressions 21. Additionally, the increased number of depressions 21 may increase the strength and/or structural integrity of the table top 12. Accordingly, less plastic may be used to make the table top 12 by increasing the number of depressions 21, which may create a lighter weight table 10.

Additionally, the depressions 21 may reduce the amount of time required to manufacture the table top 12. For example, when a blow-molded structure such as the table top 12 formed, a certain amount of time must elapse before the structure can be removed from the mold. Advantageously, blow-molded structures with thinner walls have a shorter cooling time than structures with thicker walls. Thus, the depressions 21 may allow table tops 12 with thinner plastic walls to be constructed and the cooling time required before the table tops can be removed from the mold may be decreased. Significantly, a reduced cycle time may increase the efficiency of manufacturing process and decrease the cost of the table 10.

Additional details regarding the size, shape and configuration of depressions that may suitable for use in connection with the table top 12 are disclosed in Assignee's U.S. Pat. No. 7,069,865, entitled HIGH-STRENGTH, LIGHTWEIGHT BLOW-MOLDED PLASTIC STRUCTURES, which issued on Jul. 4, 2006; and Assignee's pending U.S. patent application Ser. No. 10/963,895, which was filed Oct. 12, 2004, entitled HIGH-STRENGTH, LIGHTWEIGHT BLOW-MOLDED PLASTIC STRUCTURES, which are incorporated by reference in their entireties. One of ordinary skill in the art will appreciate that the depressions 21 may have a variety of suitable sizes, shapes and configurations depending, for example, upon the intended use of the table 10. It will also be appreciated that the table top 12 may include other features and structures, such as reinforcement portions, but the depressions and other features are not required.

As shown in FIGS. 1 and 2, the table top 12 may consist of a single, unitary, one-piece structure. The table top 12, however, could be constructed from any suitable number of sections to form, for example, a fold-in-half table. Advantageously, this may allow the table top 12 to be moved between a folded position and an unfolded position, which may facilitate transportation and storage of the table 10. Of course, the table top 12 may be constructed with any suitable number of components or sections depending, for example, upon the intended use of the table 10.

The table 10 may also include a frame 22 which is connected to the table top 12. The frame 22 may be sized and configured to increase the strength and/or rigidity of the table top 12 or the frame may simply allow, for example, the leg assembles 14, 16 to be attached to the table 10. In greater detail, as shown in FIGS. 1-2, the frame 22 may include a first side rail 24 and a second side rail 26. The first and second side rails 24, 26 are preferably disposed proximate the outer edges of the table top 12 and the side rails may extend along all or a portion of the length of the table top. In particular, the side rails 24, 26 preferably extend along at least half of the length of the table top 12; however, the side rails could be longer or shorter. As shown in the accompanying figures, the side rails 24, 26 may be connected to and/or disposed adjacent to the lip 20. It will be appreciated that the side rails 24, 26 could have a generally S-shaped, U-shaped, circular, oval, planar, or other suitable configurations; and the side rails could be connected to any desired portions of the table top 12. It will also be appreciated that the frame 22 could have other suitable components, configurations and the like.

The frame 22 is desirably constructed from metal, which may easily be formed into the desired configuration by known operations, such as stamping and bending, and the metal may be coated or painted as desired. The frame 22 may be connected to the table top 12 using one or more suitable fasteners, such as rivets, bolts or screws, adhesives and the like. Further, the side rails 24, 26 may be attached to the table top 12 using a snap fit, an interference fit, a friction fit and the like. The frame 22 may also be attached to the table top 12 without mechanical fasteners, such as disclosed in Assignee's pending U.S. patent application Ser. No. 10/409,259, which was filed on Apr. 8, 2003, entitled FRAME THAT CAN BE ATTACHED TO A TABLE TOP WITHOUT MECHANICAL FASTENERS, which is incorporated by reference in its entirety. It will be appreciated that while the frame 22 and side rails 24, 26 may have a variety of suitable sizes, shapes and configurations, neither the frame nor the side rails are required.

The table 10 may also include one or more cross bars 28 that are disposed proximate the ends of the table top 12. For example, the table 10 may include a first cross bar 28 that is disposed proximate one end of the table top 12 and a second cross bar that is disposed proximate the other end of the table top. The cross bars 28 may be attached to the side rails 24, 26 of the frame 22 and the cross bars may rotate relative to the table top 12. In particular, the ends of the cross bars 28 may be inserted into openings in the side rails 24, 26 of the frame 22 and this may allow the cross bars to rotate relative to the table top 12. The leg assemblies 14, 16 may be attached to the cross bars 28 and/or the cross bars may form a portion of the leg assemblies. Advantageously, the cross bars 28 may help facilitate movement of the leg assemblies 14, 16 between the extended and collapsed positions, but this is not required. It will be appreciated that the cross bars 28 may be connected to any suitable portion of the table 10 and the cross bars do not have to rotate relative to the table top 12. It will also be appreciated that the table 10 could have any suitable number, configuration and/or arrangement of cross bars, but cross bars are not required.

In addition, the table 10 may include one or more cross bars disposed proximate the center portion of the table top 12. For example, the table 10 may include a center cross bar 30 that is attached to the side rails 24, 26 of the frame 22 and it may rotate or be held in a generally fixed position relative to the table top 12. The cross bar 30, however, may be connected to any suitable portion of the table 10 and the cross bar could have any suitable number, configuration and/or arrangement. It will also be appreciated that the cross bar 30 is not required.

The cross bars 28 and/or cross bar 30 could also have a configuration such as shown in Assignee's pending U.S. Pat. No. 6,915,748, entitled TABLE WITH FOLDABLE LEGS, which issued on Jul. 12, 2005, which is incorporated by reference in its entirety. Of course, the cross bars 28 and/or 30 could have other appropriate sizes, designs and the like depending, for example, upon the intended use of the table 10.

In greater detail, the leg assemblies 14, 16 may be attached to the cross bars 28 and the cross bars may allow the leg assemblies to be moved between the extended and collapsed positions. For example, the leg assembly 14 may be rigidly connected to the first cross bar 28 and the first cross bar maybe pivotally connected to the frame 22 to allow the leg assembly to be moved between the extended and collapsed positions. Similarly, the leg assembly 16 may be rigidly connected to the second cross bar 28 and the second cross bar may be pivotally connected to the frame 22 to allow the leg assembly to be moved between the extended and collapsed positions. The leg assemblies 14, 16 could also be pivotally attached to the cross bars 28 and the cross bars could be rigidly attached to the frame 22. It will be appreciated that the leg assemblies 14, 16 and/or the legs 18 do not require pivotal engagement with frame 22 or the table top 12, and the leg assemblies and/or legs may be connected to the table 10 in any suitable manner such as disclosed in Assignee's pending U.S. Pat. No. 7,100,518, entitled PIVOTAL CONNECTION OF A TABLE LEG TO A FRAME, which issued on Sep. 5,2006, which is incorporated by reference in its entirety.

The table 10 may also include braces 32, 34 that may be sized and configured to, for example, secure the leg assemblies 14, 16 in the extended position. For example, a first brace 32 may be connected to the first leg assembly 14 and the cross bar 30, and a second brace 34 may be connected to the second leg assembly 16 and the same cross bar. It will be appreciated that the braces 32, 34 may be connected to different cross bars and/or different portions of the frame 22 or table top 12 depending, for example, upon the intended design or use of the table 10.

The leg assemblies 14, 16; frame 22; cross bars 28, 30 and braces 32, 34 are preferably constructed from a relatively strong material such as metal. In particular, all or a portion of these components may be constructed from steel tubes and these components may be finished, for example by painting or powder coating, to protect the components from the elements. Advantageously, the steel components may help create a table 10 that is strong and able to support a relatively large amount of weight. Preferably, the steel tubes have a generally circular cross-sectional configuration, but the tubes could have any suitable configuration such as elliptical, polygonal, oblong, square, rectangular, and the like. These and other components of the table 10, however, may be constructed from other materials with appropriate characteristics and may have other suitable sizes, shapes and configurations, depending, for example, upon the intended purpose or use of the table.

As shown in the accompanying figures, the table 10 may include one or more receiving members (such as mounting members 36, 38 and/or securing members 40, 42) that are preferably sized, shaped and configured to receive and/or retain at least a portion of another component. For example, as discussed in greater detail below, the table 10 may include one or more mounting members 36, 38, which may advantageously be sized, shaped and configured to receive and/or retain at least a portion of a cross bar (such as the cross bar 30). The table 10 may include one or more securing members 40, 42 that are sized, shaped and configured to receive and/or retain at least a portion of a leg assembly (such as leg assemblies 14, 16). The receiving members may receive and/or retain the components in a generally fixed position relative to the table top 12. The receiving members may also be sized and configured to selectively and/or securely receive and/or retain the components in the generally fixed position. In addition, the receiving members may be sized and configured to allow the components to rotate relative to the table top 12 or be held in a generally non-rotating configuration. Further, the receiving members may be sized and configured to receive and/or retain the components by a snap fit, an interference fit, a friction fit or the like.

Figure 4:
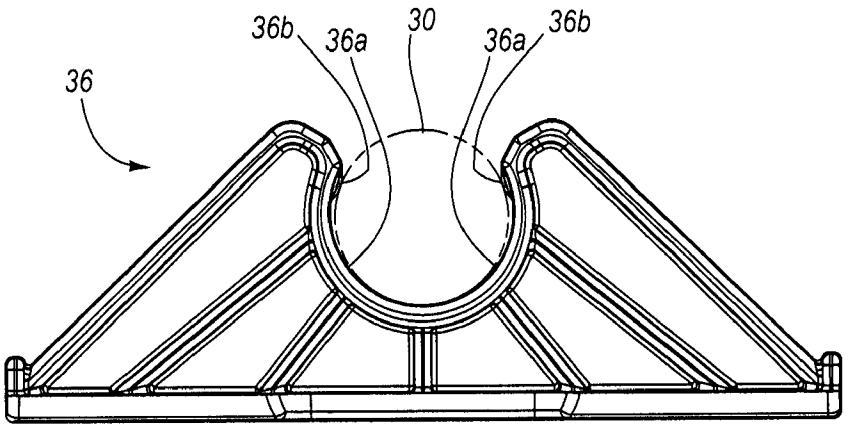
FIG. 4 is a front view of the receiving member shown in FIG. 3.
Figure 3:
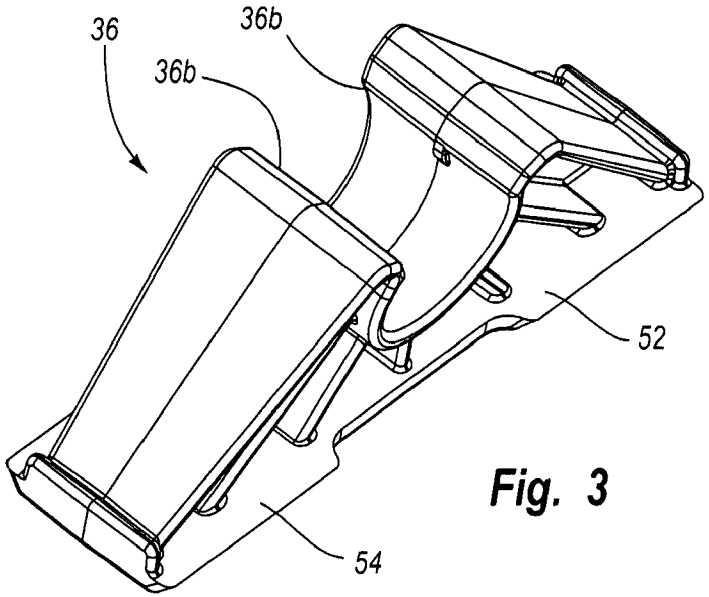
FIG. 3 is a perspective view of a portion of the table shown in FIG. 1, illustrating one of the receiving members.

In greater detail, as best seen in FIGS. 1-6, the table 10 may include one or more mounting members 36 and each mounting member may include one or more receiving portions **36*a* that are sized and configured to receive at least a portion of the cross bar 30. The mounting members 36 also preferably include one or more retaining portions 36*b*, which may be sized and configured to retain the cross bar 30 in the receiving portion 36*a*. The cross bar 30 may be received by the mounting member 36 by, for example, pushing the cross bar into the receiving portion 36*a*. As shown in FIG. 4, the opening to the receiving portion 36*a* preferably has a size that is slightly smaller than the size of the cross bar 30. Because the cross bar 30 may be slightly larger than the opening to the receiving portion 36*a*, the retaining portions 36*b* of the mounting member 36 may temporarily deform, bend, deflect or otherwise move to allow at least a portion of the cross bar 30 into the receiving portion 36*a*. When the receiving portion 36*a* receives the cross bar 30, the retaining portions 36*b*** may at least partially return to their original position to selectively retain the cross bar in the receiving portion using, for example, a snap fit, an interference fit, a friction fit or the like.

The table 10 may include one more mounting members 38 that are sized and configured to receive at least a portion of the cross bar 30. The mounting members 38 may be smaller than the mounting members 36 and the mounting members 38 may have a configuration similar to the mounting members 36. The mounting members 38, however, may also be sized and configured to guide and/or position the cross bar 30 in the desired location. The mounting members 38 may also be sized and configured to position and/or hold the cross bar 30 in the desired location in conjunction with the mounting members 36. It will be appreciated that the table 10 could include any suitable number and configuration of mounting members 36 and/or 38 depending, for example, upon the intended use of the table.

As best seen in FIGS. 1-2 and 7-11, the table 10 may include one or more securing members 40 and the securing members may include one or more receiving portions **40*a* that are sized and configured to receive at least a portion of a leg assembly 14, 16. The securing members 40 may also include one or more retaining portions 40***b* that are sized and configured to retain the leg assembly in the receiving portion 40*a*. Thus, the securing members 40 may be sized and configured to receive and retain a leg assembly 14, 16. Preferably, the securing members 40 are positioned to receive and retain the leg assembly 14, 16 in the collapsed position. Advantageously, the securing members 40 may be sized and configured to selectively receive and retain the leg assembly 14, 16 in the collapsed position, which may facilitate movement of the leg assembly between the extended and collapsed position.

In greater detail, a leg assembly 14, 16 may be moved from the extended position to the collapsed position. As the leg assembly 14, 16 approaches the collapsed position, a portion of the leg assembly may contact the retaining portion 40*b*. This contact may cause the retaining portion 40*b* to temporarily deform, bend, deflect or otherwise move to allow a portion of the leg assembly to be received by receiving portion 40*a*. When the receiving portion 40*a* receives the leg assembly, the retaining portion 40*b* may at least partially return to its original position to selectively retain the leg assembly in the receiving portion using, for example, a snap fit, an interference fit, a friction fit or the like. Thus, the securing member 40 may advantageously help prevent the leg assembly 14, 16 from being inadvertently moved from the collapsed position. When it is desired to move the leg assembly 14, 16 from the collapsed position to the extended position, the leg assembly may simply be moved with a force sufficient to remove the leg assembly from the receiving portion 40*a* and past the retaining portion 40*b*. This may again cause the retaining portion 40*b* to temporarily deform, bend, deflect or otherwise move to allow the portion of the leg assembly to move into the extended position, but the retaining portion then preferably returns to its original position.

It will be appreciated that the securing members may have other suitable configurations and arrangements. For example, the table 10 could include one or more securing members 42, as shown in FIGS. 12-16, and these securing members may include one or more receiving portions 42*a* that are sized and configured to receive at least a portion of a leg assembly 14, 16. The securing members 42 may also include one or more retaining portions 42*b*, which may be sized and configured to retain the leg assembly 14, 16 in the receiving portion 42*a*.

The securing members 42 may function similarly to the securing members 40. For example, as a leg assembly 14, 16 is moved into the collapsed position, a portion of the leg assembly may contact the retaining portions 42*b*. This contact may cause the retaining portions 42*b* to temporarily deform, bend, deflect or otherwise move to allow a portion of the leg assembly to be received by receiving portion 42*a*. When the leg assembly 14, 16 is disposed within the receiving portion 42*a*, the retaining portions 42*b* may at least partially return to their original positions to selectively retain the leg assembly in the receiving portion using, for example, a snap fit, an interference fit, a friction fit or the like. Thus, the securing members 42 may advantageously help prevent the leg assemblies 14, 16 from inadvertently moving from the collapsed position. The securing members 42 may also selectively allow the leg assemblies 14, 16 to be moved between the collapsed and extended positions.

Advantageously, the table 10 may include any suitable number and/or positioning of securing members 40, 42. For example, one securing member 40, 42 may be used to secure a single leg assembly 14, 16 in the collapsed position. In addition, two or more securing members 40, 42 may be used to secure a single leg assembly 14, 16 in the collapsed position. For example, two securing members 40 may be disposed on opposing sides or the same side of one of the leg assemblies 14, 16. Advantageously, the securing members 40 may be positioned proximate each other or in a spaced apart configuration. One or more securing members 40, 42 may also be sized and configured to receive different portions of the leg assemblies 14, 16. For instance, a first securing member 40, 42 may be sized and configured to receive a first leg 18 of the leg assembly and a second securing member may be sized and configured to receive a second leg of the leg assembly. Significantly, the securing members 40, 42 may be sized and configured to receive any desired portion of the legs assembly 14, 16, such as the legs 18 or other components such as a connecting member or foot. The securing members 40, 42 may also be sized and configured to receive any suitable number or configuration of leg assemblies 14, 16. In addition, the securing members 40, 42 may allow the leg assemblies 14, 16 to be secured in any desired positions, locations and the like, and the leg assemblies may be independently secured.

The mounting members 36, 38 and/or the securing members 40, 42 may be integrally formed as part of a unitary, one-piece structure. In addition, the mounting members 36, 38 and/or the securing members 40, 42 may be integrally formed with the table top 12 as part of a unitary, one-piece structure. If the mounting members 36, 38 and/or the securing members 40, 42 are integrally formed as part of the table top 12, then the mounting members and the securing members do not have to be connected to the table top.

The mounting members 36, 38 and the securing members 40, 42 may also be separate components that are attached to the table top 12 or other suitable portions of the table 10. In particular, the mounting members 36, 38 and the securing members 40, 42 may be sized and configured to be connected to the lower portion of the table top 12 using a snap fit, a friction fit, an interference fit or the like. Preferably, the mounting members 36, 38 and the securing members 40, 42 are selectively attached to the table top 12 to allow the mounting members and the securing members to be attached and detached from the table as desired. This may facilitate manufacturing of the table 10 because the mounting members 36, 38 and the securing members 40, 42 may be attached to the table at any desired time during the manufacturing process. In addition, this may allow consumers to attach and/or replace the mounting members 36, 38 and the securing members 40, 42 as desired. This may also increase the functionality and potential uses of the table 10 because the mounting members 36, 38 and the securing members 40, 42 could be attached at any time or not at all. Further, this may allow the same table top 12 to be used with different types and combinations of leg assemblies 14, 16; legs 18; cross bars 28, 30; mounting members 36, 38; and securing members 40, 42. Thus, for instance, the table top 12 may be used with one type of legs and securing members in one configuration and a different type of legs and securing members in another configuration. While the mounting members 36, 38 and the securing members 40, 42 are preferably attached by a snap fit, a friction fit or an interference fit, the components may be attached by using fasteners, adhesives and the like.

The receiving members, which include the mounting members 36, 38 and the securing members 40, 42, are preferably sized and configured to be connected to receiving portions. Advantageously, as discussed above, the receiving members are preferably connected to the receiving portions by a snap, friction or interference fit, but these components can be connected by any suitable manner. In addition, the receiving members are preferably connected to the table 10 in a generally similar manner, which may facilitate manufacturing and assembly of the table. It will be appreciated, however, that the receiving members could be connected to the table 10 in any suitable manner.

Figure 5:
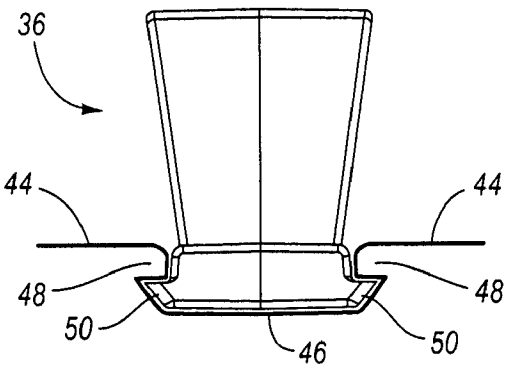
FIG. 5 is a side view of the receiving member shown in FIG. 3.
Figure 7:
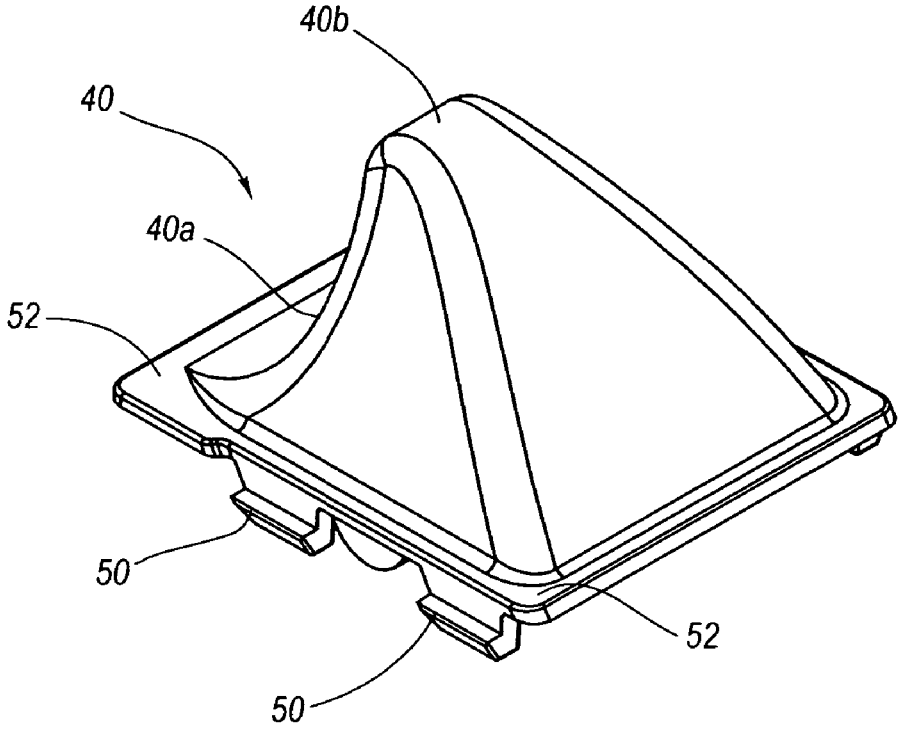
FIG. 7 is a perspective view of another portion of the table shown in FIG. 1, illustrating another of the receiving members.
Figure 8:
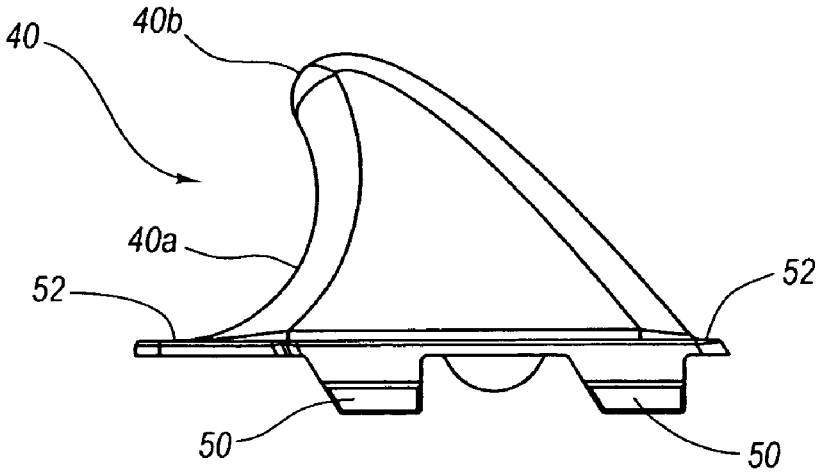
FIG. 8 is a right side view of the receiving member shown in FIG. 7.
Figure 9:
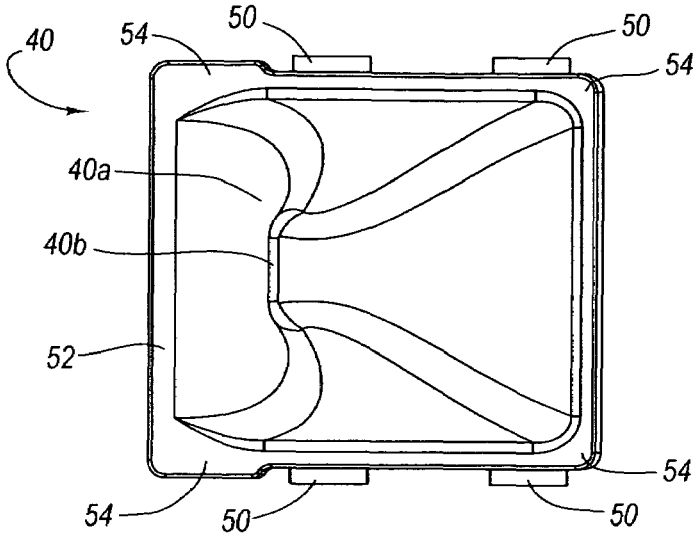
FIG. 9 is a top view of the receiving member shown in FIG. 7.
Figure 10:
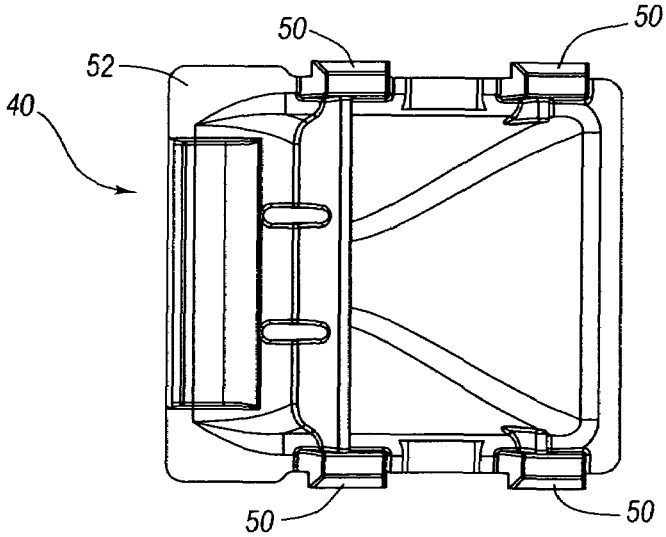
FIG. 10 is a bottom view of the receiving member shown in FIG. 7.
Figure 11:
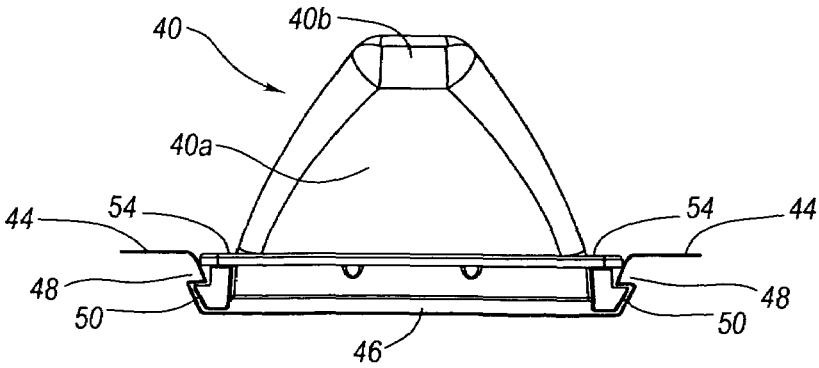
FIG. 11 is a front view of the receiving member shown in FIG. 7.
Figure 12:
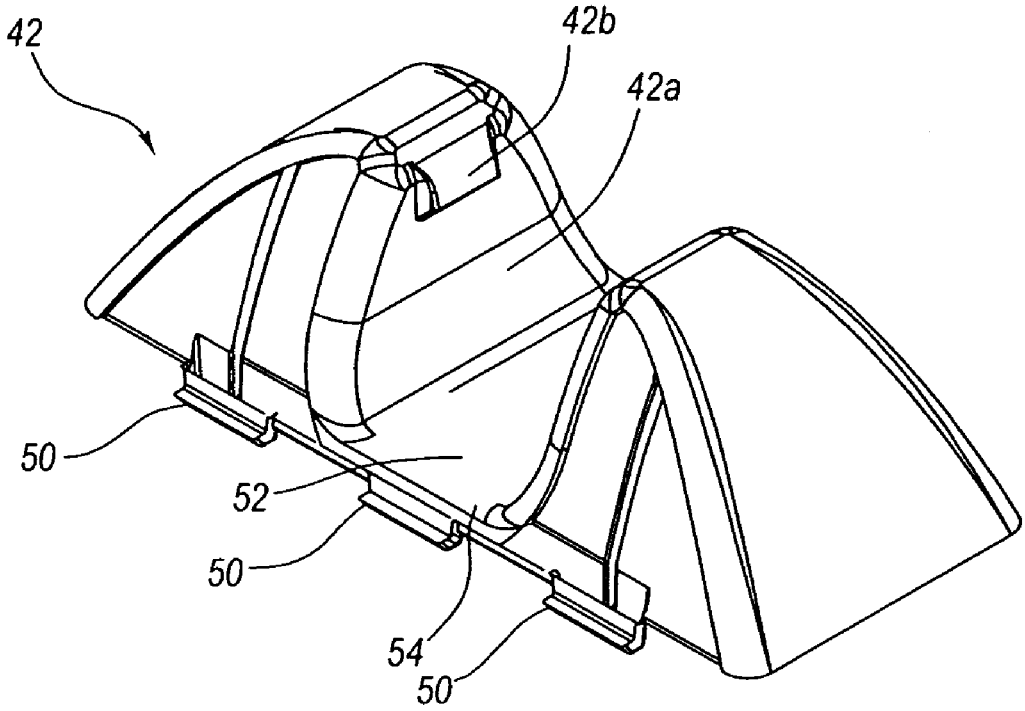
FIG. 12 is a perspective view of another exemplary embodiment of a receiving member.
Figure 13:
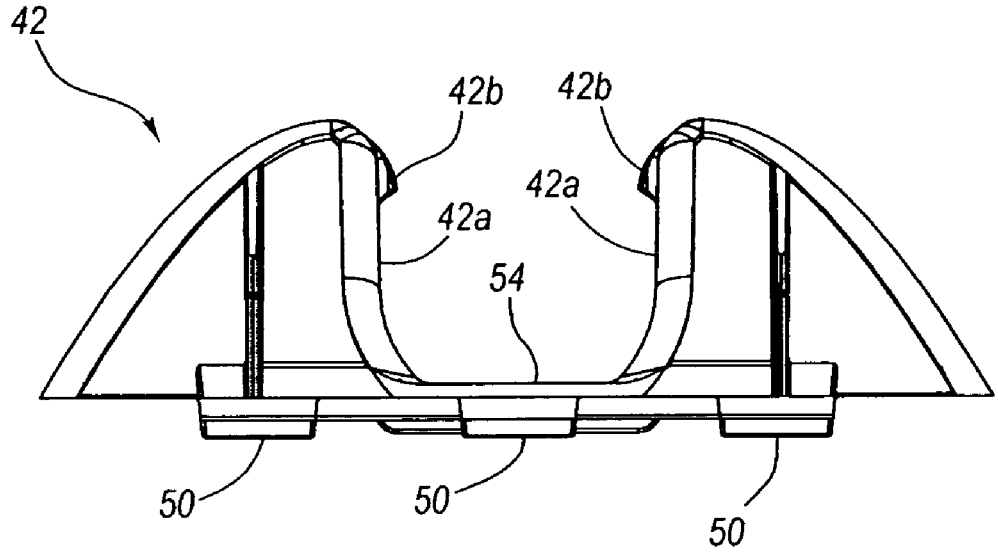
FIG. 13 is a front view of the receiving member shown in FIG. 12.
Figure 14:
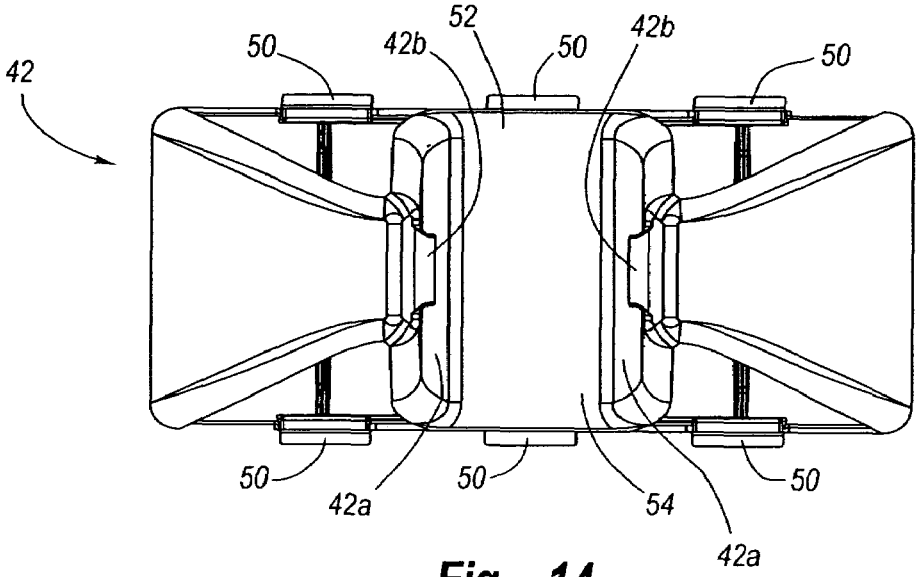
FIG. 14 is a top view of the receiving member shown in FIG. 12.
Figure 15:
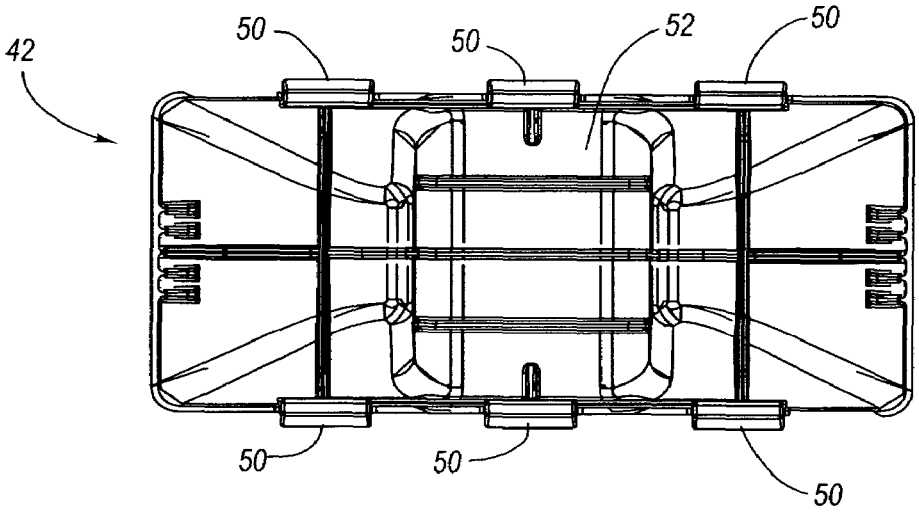
FIG. 15 is a bottom view of the receiving member shown in FIG. 12.
Figure 16:
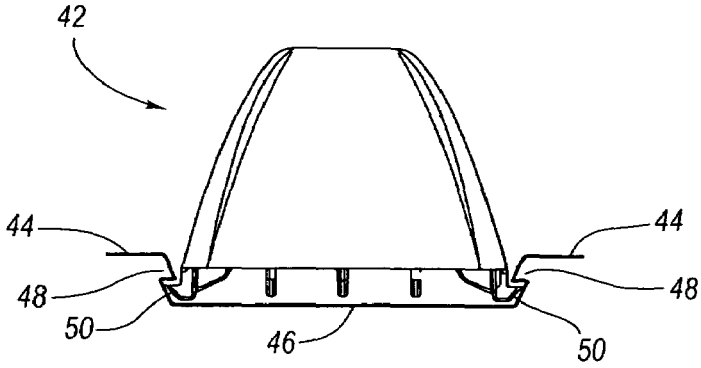
FIG. 16 is an end view of the receiving member shown in FIG. 12.

For example, as shown in FIG. 5, a lower portion 44 of the table top 12 may include a receiving portion 46 that is sized and configured to receive at least a portion of the mounting member 36. The receiving portion 46 preferably includes an opening with generally inwardly extending projections or lips 48 so that the opening is smaller than the body of the receiving portion. The mounting members 36 preferably includes corresponding outwardly extending projections or flanges 50 that are sized and configured to be inserted through the opening and received within the body of the receiving portion 46. The size of the opening to the receiving portion 46 is preferably slightly smaller than the size of the outwardly extending flanges 50 of the mounting member 36. Because the outwardly extending flanges 50 may be slightly larger than the opening of the receiving portion 46, the inwardly extending lips 48 and/or the outwardly extending flanges 50 may temporarily deform, bend, deflect or otherwise move to allow the flanges to be received within the body of the receiving portions 46. Once the flanges 50 are received into the body of the receiving portion 46, the inwardly extending lips 48 and/or the outwardly extending flanges 50 may at least partially return to their normal positions to retain the mounting member 36 in a generally fixed location. Thus, the mounting member 36 may be secured using a snap fit, an interference fit, a friction fit or the like. Advantageously, this may allow the mounting member 36 to be quickly and easily attached to the table top 12. In addition, if desired, this may allow the mounting member 36 to be quickly and easily detached from the table top 12. As shown in FIGS. 11 and 16, the securing members 40, 42 may be attached to the table top 12 in a similar manner.

As shown in the accompanying figures, the inwardly extending lips 48 of the receiving portions 46 may include a hollow interior portion. Advantageously, the hollow interior portion of the inwardly extending lips 48 may be formed during the blow-molding process and the receiving portions 46 may be integrally formed during the blow-molding process as part of a unitary, one-piece table top 12. It will be appreciated, however, that the inwardly extending lips 48 do not require a hollow interior portion and the receiving portions 46 do not have to be integrally formed with the table top 12. In contrast, for example, the receiving portions 46 could be subsequently formed in or attached to the table top 12. The receiving portions 46 may also be formed using other processes and materials.

The receiving members may also include a base 52 with an upper portion with a generally flat upper surface 54. Preferably, the upper surface 54 is generally aligned with the lower portion of the table top 12. For example, as shown in FIG. 11, the securing member 40 may be attached to the table top 12 such that the upper surface 54 is generally aligned with the lower portion 44 of the table top 12. In particular, the receiving portions 46 may include one or more recessed or angled portions that are sized and configured to receive at least a portion of the base 52 to allow the upper surface 54 to be generally aligned with the lower portion 44 of the table top 12. It will be appreciated that the mounting members 36, 38 and securing member 42 may have a similar configuration and arrangement, if desired.

Advantageously, when the upper surfaces of the base of the mounting members 36, 38 and/or the securing members 40, 42 are generally aligned with the lower portion 44 of the table top 12, the securing members and/or the mounting members may appear to be an integral portion of the table top 12. Thus, if desired, the mounting members 36, 38 and/or the securing members 40, 42 may create the appearance that the securing members and/or the mounting members were formed integrally with the table top 12. It will be appreciated that the mounting members 36, 38 and/or the securing members 40, 42 could have other suitable configurations and the bases 52 do not require a generally flat upper surface 54. It will also be appreciated that the bases 52 need not be generally aligned with any portion of the table top 12 and the mounting members 36, 38 and/or the securing members 40, 42 do not require a require a base. Further, the mounting members 36, 38, the securing members 40, 42 and the receiving portions 46 could have other suitable arrangements and configurations depending, for example, upon the design and/or intended use of the table 10.

The mounting members 36, 38 and the securing members 40, 42 are preferably constructed from injection molded plastic, such as polypropylene or other suitable type of plastic. Advantageously, the injection molded plastic mounting members 36, 38 and securing members 40, 42 may be quickly and easily manufactured. It will be appreciated, however, that the mounting members 36, 38 and securing members 40, 42 could be constructed from other suitable processes, such as extrusion molding, rotary molding, and the like. It will also be appreciated that the mounting members 36, 38 and securing members 40, 42 could be constructed from other types of plastics or materials with the appropriate characteristics.

If desired, the mounting members 36, 38 and the securing members 40, 42 may be constructed from different materials and/or processes than the table top 12. For instance, it may be desirable to have mounting members 36, 38 and/or securing members 40, 42 that have different characteristics than the table top 12. For example, it may be desirably to create mounting members 36, 38 and/or securing members 40, 42 that are more or less rigid, more or less flexible, etc., than the table top 12. By using different materials and/or processes, the mounting members 36, 38 and/or the securing members 40, 42 may have those desired, different characteristics. In particular, the mounting members 36, 38 and/or securing members 40, 42 may be formed of injection molded plastic and the table top 12 may be constructed of blow-molded plastic. It will be appreciated that the mounting members 36, 38, securing members 40, 42 and the table top 12 may also be constructed from similar processes and materials, if desired, with the same or different characteristics depending, for example, upon the intended use of the table 10.

As discussed above, the mounting members 36, 38 and/or the securing members 40, 42 may include one or more features that are integrally formed therein as part of a unitary, one-piece structure. For example, the receiving portions 36*a*, 40*a*, 42*a*; the retaining portions 36*b*, 40*b*, 42*b*; the projections 50; and/or the base portions 52 may be integrally formed as part of a unitary, one-piece structure. These features, however, do not have to be formed integrally; and the mounting members 36, 38 and securing members 40, 42 do not require these or any other particular feature. While the mounting members 36, 38 and/or the securing members 40, 42 may be formed from different processes and materials than the table top 12, one or more mounting members and/or securing members may be integrally formed in the table top 12, if desired.

Although the securing members 40, 42 have been described with reference to receiving and/or retaining at least a portion of the leg assemblies 14, 16, the securing members could also be used to receive and/or retain another portion of the table 10 such as the crossbar 30. Similarly, while the mounting members 36, 38 have been described with reference to receiving and/or retaining at least a portion of a crossbar 30, the mounting members could be used to receive and/or retain at least a portion of the leg assemblies 14, 16. In fact, the mounting members 36, 38 and/or the securing members 40, 42 may be sized, shaped and configured to receive and/or retain any suitable portion of the table. It will also be appreciated that the mounting members 36, 38 and the securing members 40, 42 may have other suitable features, designs, arrangements, configurations and the like depending, for example, upon the size and configuration of the component being received and/or retained. It will be further appreciated that the table 10 does not require mounting members 36, 38 or securing members 40, 42.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a table top constructed from blow-molded plastic, the table top including an upper surface, a lower surface and a hollow interior portion that is at least partially disposed between the upper surface and the lower surface, the hollow interior portion being formed during the blow-molding process;

a leg assembly movable between a collapsed position and an extended position relative to the table top;

a first receiving portion integrally formed in the lower surface of the table top as part of a unitary, one-piece construction during the blow-molding process; and a first securing member including an engaging portion that is sized and configured to be selectively connected to the first receiving portion, the first securing member being sized and configured to receive and retain at least a portion of the leg assembly when the leg assembly is in the collapsed position.

2. The table of claim 1, wherein the engaging portion of the first securing member includes one or more projections that are sized and configured to be inserted into and received within the first receiving portion to connect the first securing member to the first receiving portion.

3. The table of claim 1, wherein the first securing member is connected to the first receiving portion using a snap fit, a friction fit or an interference fit.

4. The table of claim 1, wherein the first receiving portion includes one or more projections that are sized and configured to engage the first securing member when the first securing member is connected to the first receiving portion.

5. The table of claim 1, wherein the first receiving portion includes an opening that is sized and configured to receiving the engaging portion of the first securing member, the opening having a smaller size than the engaging portion of the first securing member.

6. The table of claim 5, wherein the engaging portion of the first securing member includes one or more outwardly extending flanges, the outwardly extending flanges having a size slightly larger than the opening to the first receiving portion and being sized and configured to be received within the first receiving portion.

7. The table of claim 1, further comprising a second receiving portion and a second securing member, the second securing member being sized and configured to be selectively connected to the second receiving portion, the second securing member being sized and configured to receive and retain at least a portion of the leg assembly when the leg assembly is in the collapsed position.

8. A table comprising:

a table top including an upper portion and a lower portion;

a frame connected to the table top;

a leg assembly movable relative to the table top between a collapsed position and an extended position;

a receiving portion integrally formed in the table top as part of a unitary, one-piece construction, the receiving portion including an opening; and a receiving member including a first portion and a second portion, the first portion being sized and configured to be coupled to the receiving portion formed in the table top by disposing at least a portion of the first portion in the opening of the receiving portion, the second portion being sized and configured to receive and retain a portion of the table in a fixed position.

9. The table as in claim 8, wherein the receiving portion is at least substantially disposed inwardly from the lower portion of the table top.

10. The table as in claim 8, wherein the table top includes a hollow interior portion at least partially disposed between the upper portion and the lower portion of the table top; and wherein the receiving portion includes a lip with a hollow interior portion, the hollow interior portion of the lip being integrally formed with the hollow interior portion of the table top.

11. The table as in claim 8, wherein the receiving member is connected to the receiving portion by a snap, friction or interference fit.

12. The table as in claim 8, wherein the receiving member is a mounting member that is sized and configured to receive and retain at least a portion of the frame in a generally fixed position.

13. The table as in claim 8, wherein the receiving member is a securing member that is sized and configured to receive and retain at least a portion of the leg assembly in a generally fixed position.

14. The table as in claim 8, wherein the first portion of the receiving member includes an upper surface that is sized and configured to be generally aligned with the lower portion of the table top.

15. The table as in claim 8, wherein the receiving member is sized and configured to be selectively attached to the receiving portion.

16. The table as in claim 8, wherein the table top is constructed from plastic with a first set of characteristics and the receiving member is constructed from plastic with a second set of characteristics, the first set of characteristics being different than the second set of characteristics.

17. The table as in claim 8, wherein the table top is constructed from a material with a first set of characteristics and the receiving member is constructed from a different material with a second set of characteristics, the first set of characteristics being different than the second set of characteristics.

* * * * *

UNITED STATES PATENT AND TRADEMARK OFFICE

CERTIFICATE OF CORRECTION

PATENT NO. : 7,299,754 B2
APPLICATION NO. : 11/140719
DATED : November 27, 2007
INVENTOR(S) : Stanford et al.

It is certified that error appears in the above-identified patent and that said Letters Patent is hereby corrected as shown below:

Column 11
Line 27, change “maybe” to --may be--

Signed and Sealed this

Twenty-ninth Day of July, 2008

JON W. DUDAS
*Director of the United States Patent and Trademark Office*